US011600150B2

(12) United States Patent
Oh et al.

(10) Patent No.: US 11,600,150 B2
(45) Date of Patent: Mar. 7, 2023

(54) MEDIUM STACKING SHEET AND MEDIUM SEPARATING AND STACKING APPARATUS INCLUDING THE SAME

(71) Applicant: HYOSUNG TNS INC., Seoul (KR)

(72) Inventors: Hye Bin Oh, Incheon (KR); Jun Young Kim, Gyeonggi-do (KR); Jong Seong Park, Gyeonggi-do (KR); Chang Ho Park, Gyeonggi-do (KR); Jungwhan Lee, Gyeonggi-do (KR)

(73) Assignee: HYOSUNG TNS INC., Soul (KR)

( * ) Notice: Subject to any disclaimer, the term of this patent is extended or adjusted under 35 U.S.C. 154(b) by 239 days.

(21) Appl. No.: 17/073,435

(22) Filed: Oct. 19, 2020

(65) Prior Publication Data

US 2021/0125465 A1 Apr. 29, 2021

(30) Foreign Application Priority Data

Oct. 25, 2019 (KR) ..... 10-2019-0134033
Dec. 19, 2019 (KR) ..... 10-2019-0170855

(51) Int. Cl.
*G07F 19/00* (2006.01)
*G07D 11/16* (2019.01)

(52) U.S. Cl.
CPC ..... *G07F 19/201* (2013.01); *G07D 11/16* (2019.01); *G07D 2211/00* (2013.01)

(58) Field of Classification Search
CPC .... G07F 19/201; G07D 11/16; G07D 2211/00
USPC ..... 271/109
See application file for complete search history.

(56) References Cited

U.S. PATENT DOCUMENTS

2008/0001351 A1 1/2008 Lee et al.
2008/0001352 A1 1/2008 Jeong
2015/0371480 A1* 12/2015 Luo ..... B65H 31/3045 271/1
2016/0163143 A1* 6/2016 Mizoro ..... B65H 29/12 271/306
2019/0304233 A1* 10/2019 Nishida ..... G07F 19/202

FOREIGN PATENT DOCUMENTS

JP H0475957 A 3/1992
JP 2836209 B2 10/1998
JP 2017134640 A 8/2017
KR 10-2018-0075762 A 7/2014

OTHER PUBLICATIONS

Office Action dated Dec. 14, 2021 in corresponding Indian application No. 2020 14044515.

* cited by examiner

*Primary Examiner* — Daniel A Hess
(74) *Attorney, Agent, or Firm* — Bacon & Thomas, PLLC

(57) ABSTRACT

A medium stacking sheet is installed on a rotation shaft of a medium separating and stacking apparatus for stacking or dispensing a medium. The medium stacking sheet includes a body fixed to the rotation shaft and having a plurality of rotation holes which are spaced apart from each other in a rotation direction of the rotation shaft, and a plurality of vanes each including a vane pin rotatably installed in a corresponding rotation hole and a vane piece coupled to the vane pin to stack the medium.

15 Claims, 13 Drawing Sheets

MEDIUM STACKING SHEET AND MEDIUM SEPARATING AND STACKING APPARATUS INCLUDING THE SAME

CROSS-REFERENCE TO RELATED APPLICATIONS

This application is based on and claims priority to Korean Patent Application No. 10-2019-0134033, filed on Oct. 25, 2019 and Korean Patent Application No. 10-2019-0170855, filed on Dec. 19, 2019, the disclosures of which are incorporated herein in its entirety by reference.

TECHNICAL FIELD

The present disclosure relates to a medium stacking sheet and a medium separating and stacking apparatus including the same.

BACKGROUND

In general, an automated teller machine (ATM) can provide a convenient financial service to a customer in a bank or other financial institution regardless of the location and time. For example, the automated teller machine can provide various financial services such as depositing or withdrawing a medium such as a bill or a check, checking balances, and transferring accounts.

A medium storage part of the automatic teller machine is equipped with a medium separating and stacking apparatus for stacking a medium such as a bill or a check in the medium storage part or dispensing the medium stacked in the medium storage part one by one.

The medium separating and stacking apparatus may include a pickup roller for dispensing a medium one by one from the medium storage part, a feed roller disposed adjacent to the pickup roller to feed the medium separated by the pickup roller onto a conveyance path or to stack the medium conveyed along the conveyance path into the medium storage part, a guide roller for conveying the medium in a state in which the guide roller overlaps with the feed roller, and a medium stacking sheet having a plurality of vanes arranged on its outer circumferential surface. When stacking a medium, the vanes of the medium stacking sheet are rotated by a driving part to strike the rear end of the medium on the conveyance path, whereby the medium can be uniformly stacked in the medium storage part.

However, in the case of a conventional medium stacking sheet (see, Korean Patent Application Publication No. 10-2018-0075762 (published on Jul. 5, 2018)), when dispensing the medium, the vanes of the medium stacking sheet may continuously rub against a medium stacking sheet cover. When the vanes of the medium stacking sheet interfere with surrounding components, an excessive load may be generated. In an idle state, the vane connection portions of the medium stacking sheet are kept in an excessively bent state. Therefore, the durability of the components may be deteriorated.

SUMMARY

Embodiments of the present disclosure provide a medium stacking sheet capable of preventing damage to connection portions between vanes and a body and capable of improving the medium stacking/dispensing performance, and a medium separating and stacking apparatus including the same.

In accordance with a first embodiment of the present disclosure, there is provided a medium stacking sheet installed on a rotation shaft of a medium separating and stacking apparatus for stacking or dispensing a medium, including: a body fixed to the rotation shaft and having a plurality of rotation holes which are spaced apart from each other in a rotation direction of the rotation shaft; and a plurality of vanes each including a vane pin rotatably installed in a corresponding rotation hole and a vane piece coupled to the vane pin to stack the medium.

The body may further include: a support plate having a central hole to which the rotation shaft is coupled, the rotation holes being disposed in an edge portion of the support plate; a plurality of stopper bump portions provided to be circumferentially spaced apart from each other in a central portion of the support plate; and a plurality of stopper groove portions each of which is formed between the adjacent stopper bump portions so that at least a portion of the vane piece is rotated within a predetermined angular range when the vane piece is unfolded.

The support plate may include: a first plate piece provided to have a semicircular shape; and a second plate piece provided to have a semicircular shape corresponding to the first plate piece and assembled to the first plate piece by snap-fit.

The vane pin may include: a support portion to which one end of the vane piece is fixed; and shaft portions provided at both ends of the support portion to be rotatably inserted into the rotation holes.

The vane piece may include: a vane portion; a coupling portion provided at one end of the vane portion to be coupled to the vane pin; a stopper portion protruded from the coupling portion, the stopper portion being located in each of the stopper groove portions of the body to limit rotation of the vane piece; and a protruding portion formed to protrude from the other end of the vane portion in a direction perpendicular to an extension direction of the vane portion.

The vanes may be rotatably coupled in an outer peripheral portion of the body and are configured to stack the medium by being unfolded from the body when the body is rotated in order for a medium to be stacked and configured to be folded toward the body when the body is rotated in order for a medium to be dispensed.

In accordance with a second embodiment of the present disclosure, there is provided a medium stacking sheet installed on a rotation shaft of a medium separating and stacking apparatus for stacking or dispensing a medium, including: a body having an outer circumferential surface and a plurality of mounting grooves formed on the outer circumferential surface, the body being rotatably fixed to the rotation shaft; and a plurality of vanes each including a vane pin rotatably coupled in a corresponding mounting groove and a vane piece fixed to the vane pin to stack the medium.

The medium stacking sheet may further include a plurality of stoppers each provided on the body to limit a rotation of the vane pin within a predetermined angle range when the vane piece is unfolded.

The vane pin may include: a support base rotatably coupled with the corresponding mounting groove, one end of the vane piece being fixed to the support base; and locking pieces provided at both ends of the support base in an axial direction of the rotation shaft.

Each of the locking pieces may include: a first locking portion having a semi-circular shape, wherein the first locking portion is supported by a corresponding stopper when the vane piece is unfolded; a second locking portion having a semi-circular shape, wherein the second locking portion is disposed opposite to the first locking portion and has a smaller diameter than the first locking portion to avoid interference with the corresponding stopper; and an elastic groove portion provided in a groove shape between the first locking portion and the second locking portion.

The first locking portion and the second locking portion may be disposed symmetrically at both ends of the support base with respect to a central longitudinal cross section of the support base.

The vanes may be rotatably coupled on the outer circumferential surface of the body and are configured to stack the medium by being unfolded from the body when the body is rotated in order for a medium to be stacked and configured to be folded toward the body when the body is rotated in order for a medium to be dispensed.

In accordance with a third embodiment of the present disclosure, there is provided a medium separating and stacking apparatus including: a rotation shaft configured to be rotated when stacking or dispensing a medium; and a medium stacking sheet installed on the rotation shaft, wherein the medium stacking sheet includes: a body having an outer circumferential surface and a plurality of mounting grooves formed on the outer circumferential surface, the body being rotatably fixed to the rotation shaft; and a plurality of vanes each including a vane pin rotatably coupled in a corresponding mounting groove and a vane piece fixed to the vane pin to stack the medium.

The medium stacking sheet may further include: a plurality of stoppers each provided on the body to limit a rotation of the vane pin within a predetermined angle range when the vane piece is unfolded.

The vane pin may include: a support base rotatably coupled with the corresponding mounting groove, one end of the vane piece being fixed to the support base; and locking pieces provided at both ends of the support base in an axial direction of the rotation shaft.

Each of the locking pieces may include: a first locking portion having a semi-circular shape, wherein the first locking portion is supported by a corresponding stopper when the vane piece is unfolded; a second locking portion having a semi-circular shape, wherein the second locking portion is disposed opposite to the first locking portion and has a smaller diameter than the first locking portion to avoid interference with the corresponding stopper; and an elastic groove portion provided in a groove shape between the first locking portion and the second locking portion.

The first locking portion and the second locking portion may be disposed symmetrically at both ends of the support base with respect to a central longitudinal cross section of the support base.

The vanes may be rotatably coupled on the outer circumferential surface of the body and are configured to stack the medium by being unfolded from the body when the body is rotated in order for a medium to be stacked and configured to be folded toward the body when the body is rotated in order for a medium to be dispensed.

According to the embodiments of the present disclosure, the vanes of the medium stacking sheet are rotatably mounted on the body. Therefore, it is possible to prevent damage to the connection portions of the vanes due to the bending of the vanes.

DETAILED DESCRIPTION

Figure 1:
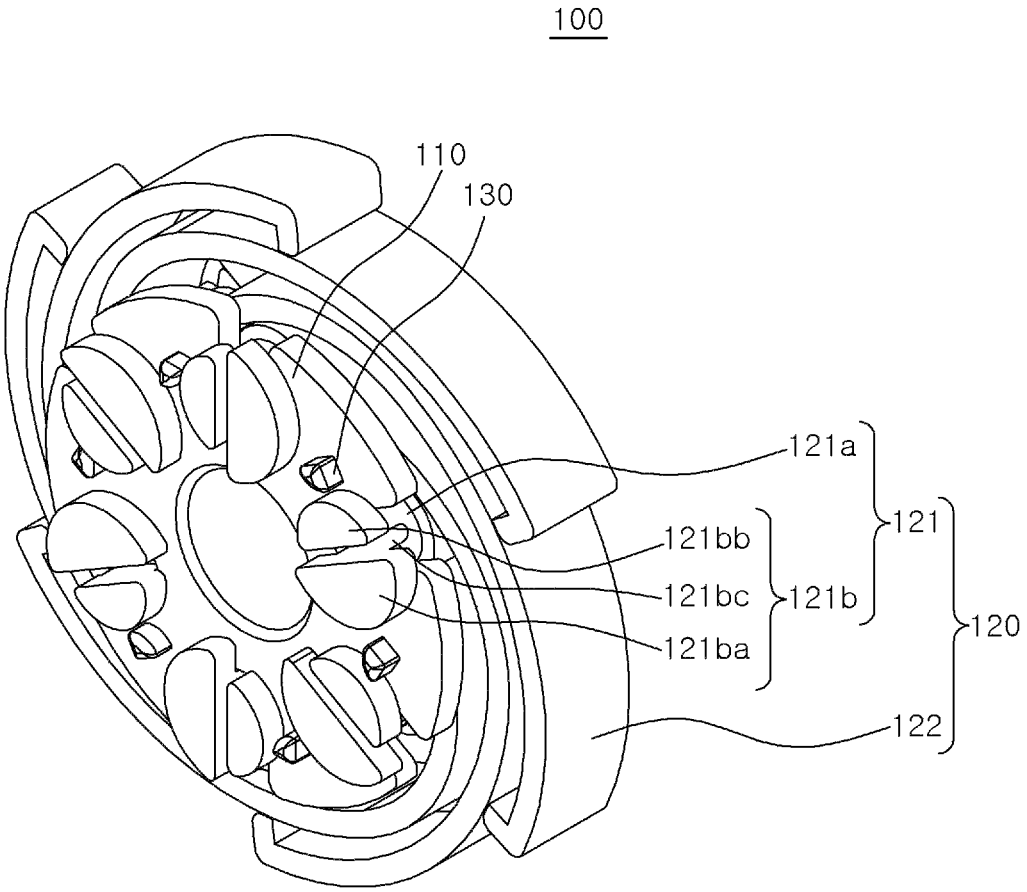
FIG. 1 is a perspective view showing a medium stacking sheet according to a first embodiment of the present disclosure.

Hereinafter, configurations and operations of embodiments will be described in detail with reference to the accompanying drawings. The following description is one of various patentable aspects of the disclosure and may form a part of the detailed description of the disclosure.

In describing the embodiments of the present disclosure, the detailed descriptions of well-known functions or configurations will be omitted if it is determined that the detailed descriptions of well-known functions or configurations may unnecessarily make obscure the spirit of the present disclosure.

The disclosure may be variously modified and may include various embodiments. Specific embodiments will be exemplarily illustrated in the drawings and described in the detailed description of the embodiments. However, it should be understood that they are not intended to limit the disclosure to specific embodiments but rather to cover all modifications, similarities, and alternatives which are included in the spirit and scope of the disclosure.

The terms used herein, including ordinal numbers such as "first" and "second" may be used to describe, and not to limit, various components. The terms simply distinguish the components from one another.

When it is said that a component is "connected" or "linked" to another component, it should be understood that the former component may be directly connected or linked to the latter component or a third component may be interposed between the two components.

Specific terms in the present disclosure are used simply to describe specific embodiments without limiting the present disclosure. An expression used in the singular encompasses the expression of the plural, unless it has a clearly different meaning in the context.

Hereinafter, an embodiment of the present disclosure will be described in detail with reference to the accompanying drawings.

Figure 2:
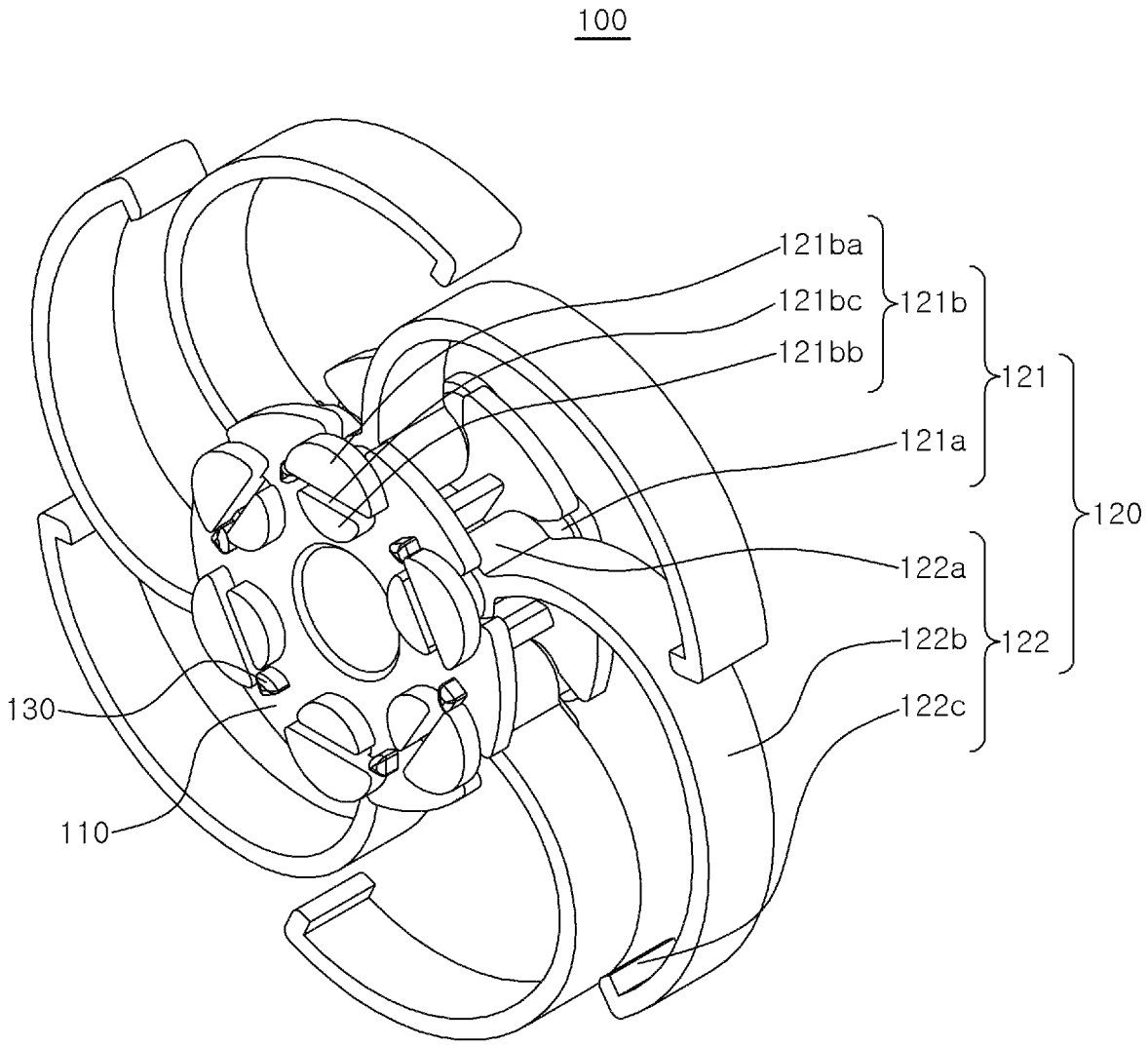
FIG. 2 is a perspective view showing a state in which the vanes are unfolded in the medium stacking sheet to the first embodiment of the present disclosure.
Figure 3:
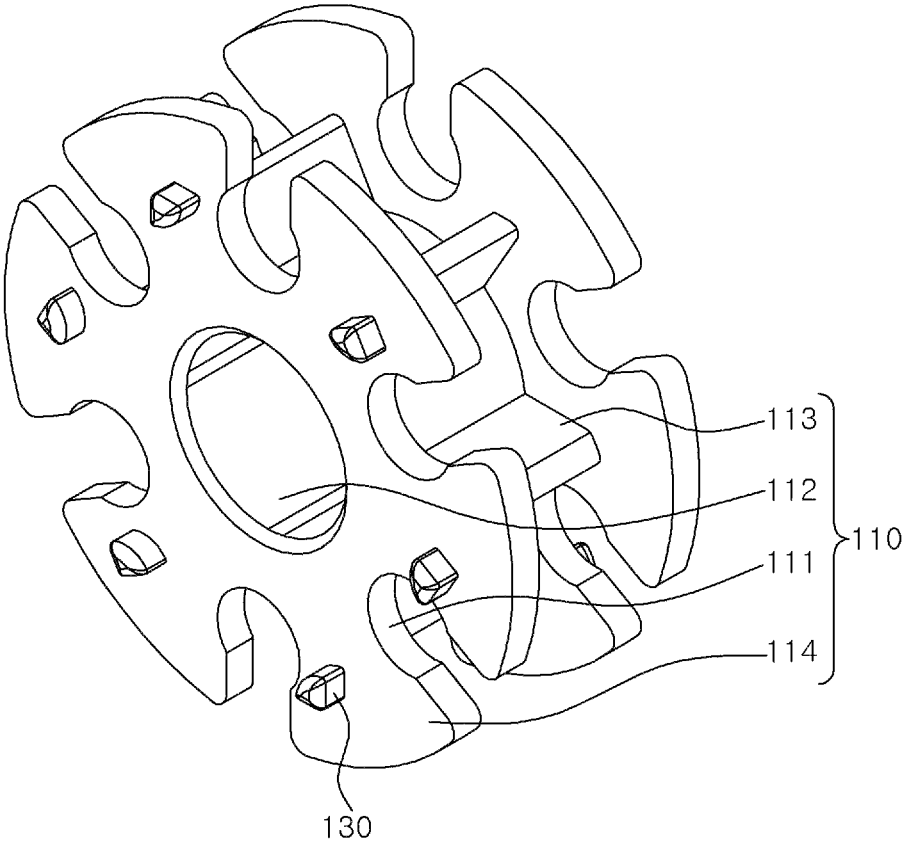
FIG. 3 is a perspective view showing the body of the medium stacking sheet according to the first embodiment of the present disclosure.
Figure 4:
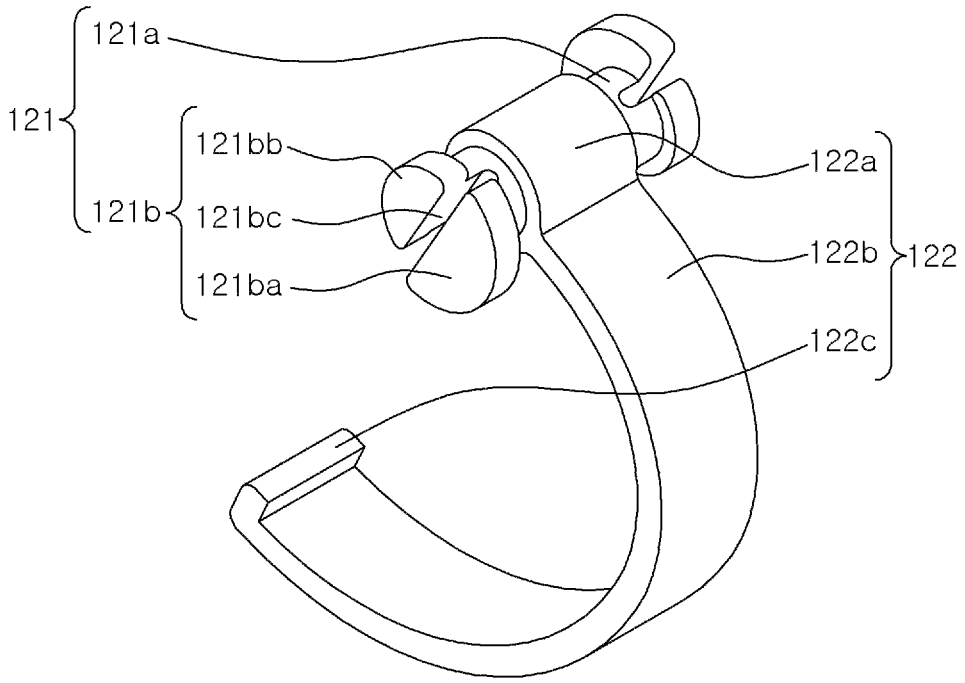
FIG. 4 is a perspective view showing one of the vanes of the medium stacking sheet according to the first embodiment of the present disclosure.

FIG. 1 is a perspective view showing a medium stacking sheet according to a first embodiment of the present disclosure. FIG. 2 is a perspective view showing a state in which the vanes are unfolded in the medium stacking sheet to the first embodiment of the present disclosure. FIG. 3 is a perspective view showing the body of the medium stacking sheet according to the first embodiment of the present disclosure. FIG. 4 is a perspective view showing one of the vanes of the medium stacking sheet according to the first embodiment of the present disclosure.

As shown in FIGS. 1 to 4, the medium stacking sheet 100 according to a first embodiment of the present disclosure may include a body 110, vanes 120 and stoppers 130.

Specifically, the body 110 may be fixed to a rotation shaft of a guide roller for stacking or dispensing a medium. To this end, the body 110 may include a support plate 114 having a central hole 112 to which the rotation shaft can be coupled. There may be provided a pair of support plates 114 disposed opposite to each other and connected through support ribs 113.

The body 110 may include mounting grooves 111 formed in a groove shape on the outer periphery of the support plate 114. The mounting grooves 111 may be spaced apart at regular intervals along the edge of the support plate 114. The mounting grooves 111 may be formed in a shape corresponding to the vane pins 121 of the vanes 120 so that the vanes 120 can be rotatably mounted to the mounting grooves 111.

The vanes 120 may be rotatably mounted to the mounting grooves 111 of the body 110. When the body 110 is rotated in a medium stacking direction, the vanes 120 may be unfolded from the body 110 so that the medium can be stacked in a stacking space of a medium storage part. In addition, when the body 110 is rotated in a medium dispensing direction, the vanes 120 may be simultaneously folded toward the body 110 so as not to interfere with the medium, whereby the vanes 120 can be retracted from a medium conveyance path.

Each of the vanes 120 may include a vane pin 121 rotatably mounted to each of the mounting grooves 111 and a vane piece 122 coupled to the vane pin 121 so as to stack a medium.

The vane pin 121 of each of the vanes 120 may have a diameter corresponding to the diameter of each of the mounting grooves 111 so that the vane pin 121 can be rotatably mounted to each of the mounting grooves 111. The vane pin 121 may include a support base 121*a* to which one end of the vane piece 122 is fixed, and locking pieces 121*b* provided at both ends of the support base 121*a*. The support base 121*a* may be rotated in each of the mounting grooves 111 as the body 110 rotates. At this time, the vane piece 122 may be rotate about the support base 121*a* so that the vane piece 122 may be wound around the body 110 or may be unfolded from the body 110.

The locking piece 121*b* of each of the vanes 120 may include a first semi-circular locking portion 121*ba*, a second semi-circular locking portion 121*bb* disposed opposite to the first locking portion 121*ba* and having a smaller diameter than the first locking portion 121*ba*, and an elastic groove portion 121*bc* provided in a groove shape between the first locking portion 121*ba* and the second locking portion 121*bb*. The first locking portion 121*ba* and the second locking portion 121*bb* may be disposed symmetrically at both ends of the support base 121*a* with respect to the central longitudinal cross section of the support base 121*a*.

Accordingly, it is possible to prevent the vane pin 121 from being removed out of each of the mounting grooves 111 of the body 110. In addition, when the vane piece 122 rotates together with the rotation of the body 110, more specifically when the vane piece 122 is unfolded from the body 110, the first locking portion 121*ba* may be supported by each of the stoppers 130 to limit the rotation of the body 110 to within a certain angular range. At this time, the second locking portion 121*bb* can be prevented from interfering with each of the stoppers 130 because the second locking portion 121*bb* has a smaller diameter than the first locking portion 121*ba*.

The vanes 120 of the medium stacking sheet 100 may be made of a flexible material. In this case, the vanes 120 may be made of a flexible material that is restricted from being unfolded (bent) over 90 degrees from the body 110 when the body 110 is rotated in the medium stacking direction. Each of the vanes 120 may include a vane portion 122*b*, a coupling portion 122*a* provided at one end of the vane portion 122*b* so as to be coupled to the support base 121*a*, and a protruding portion 122*c* protruding from the other end of the vane portion 122*b* in a direction perpendicular to an extension direction of the vane portion 122*b*.

The stoppers 130 may be provided to protrude from the support plate 114 of the body 110 with each of the mounting grooves 111 interposed therebetween. Each of the stoppers 130 may be positioned on the rotation path of the first locking portion 121*ba* of each of the locking pieces 121*b*. Each of the stoppers 130 may be provided in the form of a right-angled semicircular column.

Each of the stoppers 130 may limit the rotation of the vane pin 121 to within a certain angular range when the vane piece 122 is unfolded. For example, when the vane piece 122 is unfolded from the body 110 in response to the rotation of the body 110, the first locking portion 121*ba* of the locking piece 121*b* comes into contact with each of the stoppers 130. Therefore, the rotation of each of the vanes 120 may be limited to within a certain angular range even when the body 110 continues to rotate.

Figure 5:
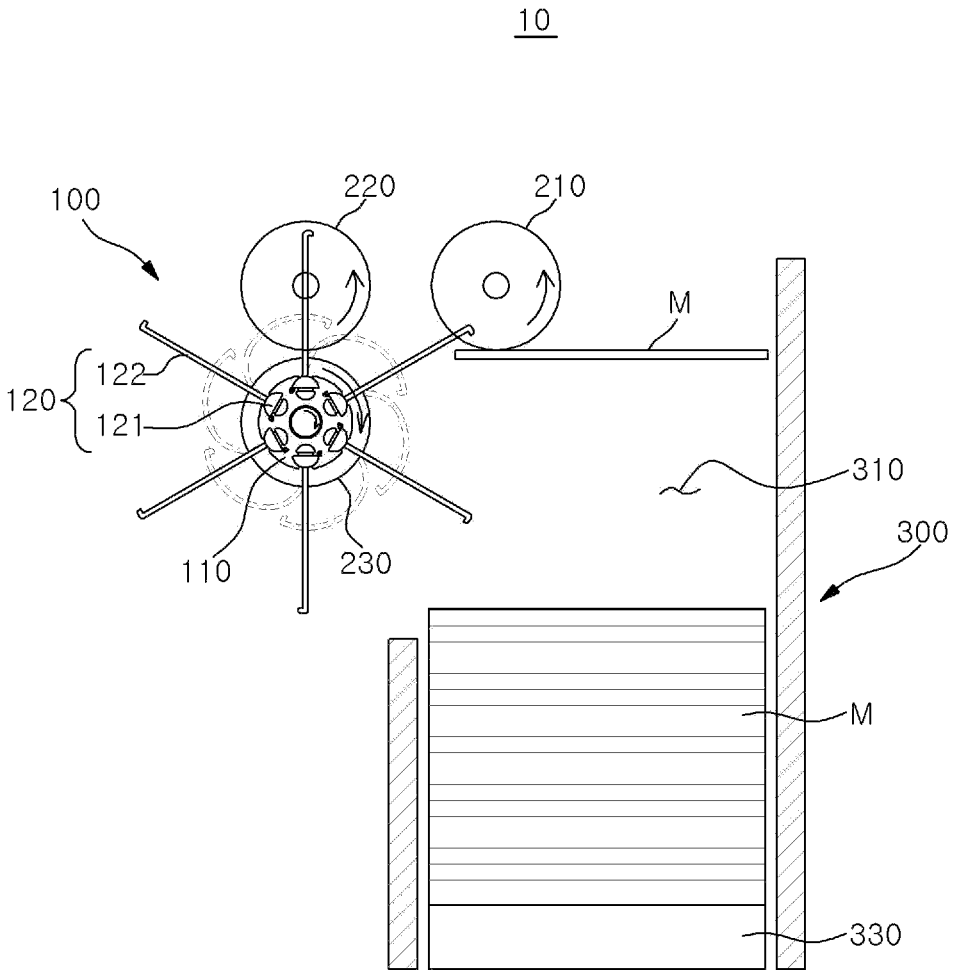
FIG. 5 is a view illustrating the state of the medium stacking sheet when a medium is stacked in a medium separating and stacking apparatus according to the first embodiment of the present disclosure.
Figure 6:
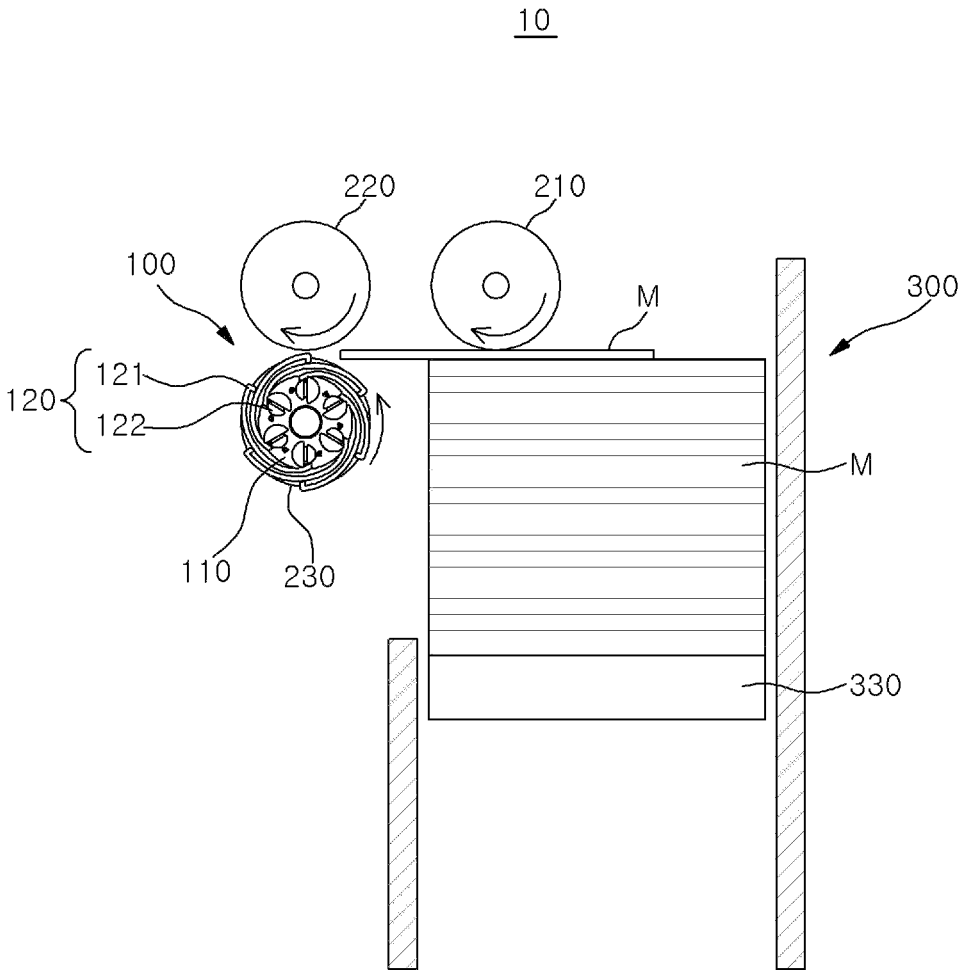
FIG. 6 is a view illustrating the state of the medium stacking sheet when a medium is separated from the medium separating and stacking apparatus according to the first embodiment of the present disclosure.

FIG. 5 is a view illustrating the state of the medium stacking sheet when a medium is stacked in a medium separating and stacking apparatus according to the first embodiment of the present disclosure. FIG. 6 is a view illustrating the state of the medium stacking sheet when a medium is separated from the medium separating and stacking apparatus according to the first embodiment of the present disclosure.

As shown in FIGS. 5 to 6, the medium separating and stacking apparatus 10 according to the first embodiment of the present disclosure may include a medium storage part 300 capable of stacking a medium M, and a stacking/dispensing part for stacking the medium M in the medium storage part 300 through the medium stacking sheet 100.

Specifically, the medium storage part 300 may be provided in the form of a box capable of storing the medium M. The medium storage part 300 may provide a stacking space 310 capable of storing the medium M. A stacking plate 330 movable in the vertical direction may be provided in the stacking space 310. The medium M may be stacked on the upper surface of the stacking plate 330.

The stacking plate 330 may be moved to the lower side of the medium storage part 300 to secure the stacking space 310 for the medium M. When stacking the medium M, the medium M passed through the stacking/dispensing part may be dropped and stacked in the stacking space 310 while the rear end of the medium M is struck by the vanes 120 of the medium stacking sheet 100.

In addition, the stacking plate 330 may be moved to the upper side of the medium storage part 300 to separate the medium M stored in the stacking space 310 to the outside. The vertical movement of the stacking plate 330 may be implemented through an actuator controlled by a controller.

The stacking/dispensing part may include a pickup roller 210 for dispensing the medium M one by one from the medium storage part 300, a feed roller 220 disposed adjacent to the pick-up roller 210 and configured to transfer the medium M separated by the pick-up roller 210 onto the conveyance path P or stack the medium M conveyed along the conveyance path P into the medium storage part 300, a guide roller 230 overlapped with the feed roller 220 and configured to feed the medium M while preventing two sheets of medium M from being conveyed simultaneously, and a medium stacking sheet 100 provided coaxially with the rotation axis of the guide roller 230.

A plurality of vanes 120 may be arranged on the outer circumferential surface of the medium stacking sheet 100 so as to be spaced apart along the circumferential direction. The detailed configuration of the medium stacking sheet 100 corresponds to the one described above. Therefore, the detailed description thereof will be omitted.

As shown in FIG. 5, in the process of stacking the medium M conveyed along the conveyance path into the medium storage part 300, the medium stacking sheet 100 enters the conveyance path to strike the rear end of the medium M, whereby the medium M can be uniformly stacked into the medium storage part 300.

As shown in FIG. 6, in the process in which the medium M is separated from the medium storage part 300 toward the conveyance path, the vanes 120 of the medium stacking sheet 100 is folded toward body 110 so as not to interfere with the medium M, whereby the medium stacking sheet 100 can be retracted from the conveyance path.

As described above, according to the first embodiment of the present disclosure, the vanes of the medium stacking sheet are rotatably mounted on the body. Therefore, it is possible to prevent damage to the connection portions of the vanes due to the bending of the vanes.

Second Embodiment

Hereinafter, a second embodiment of the present disclosure will be described with reference to FIGS. 7 to 13.

Figure 7:
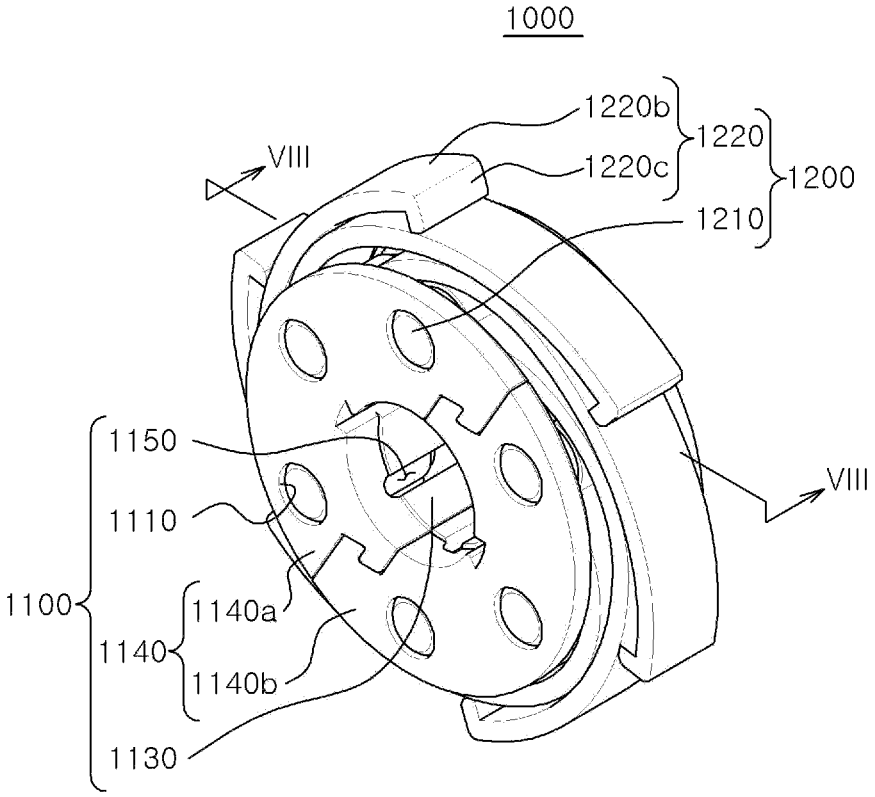
FIG. 7 is a perspective view showing a medium stacking sheet according to a second embodiment of the present disclosure.
Figure 8:
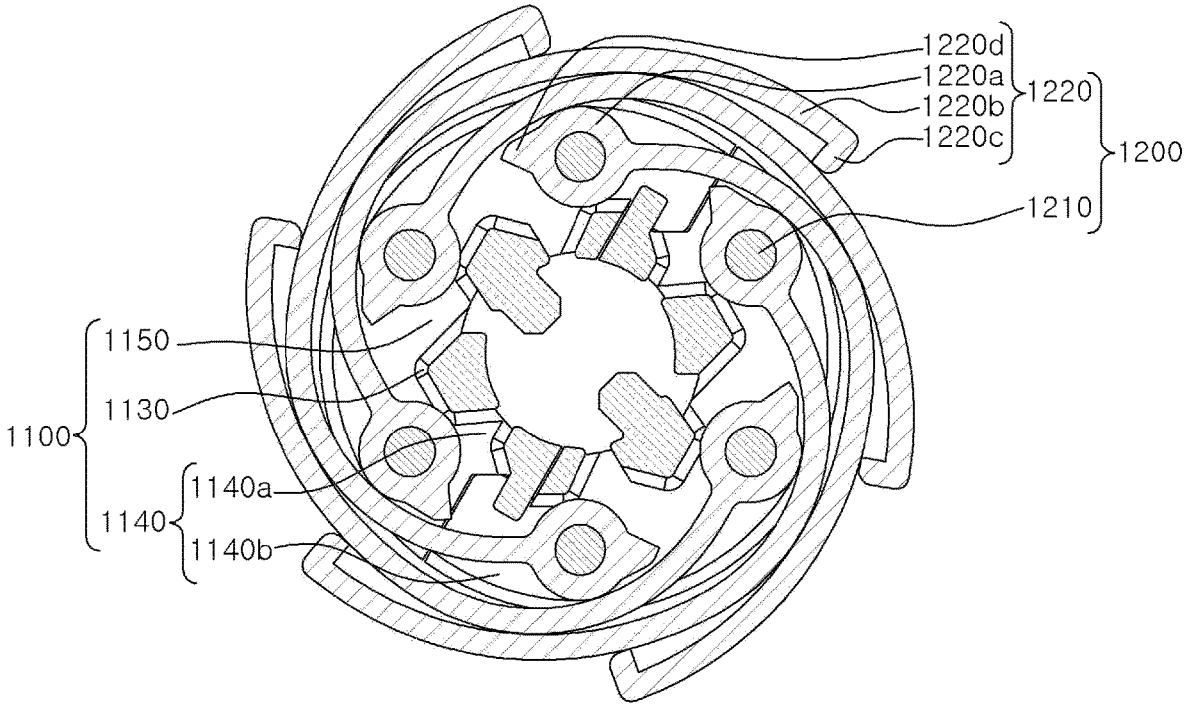
FIG. 8 is a sectional view taken along line VIII-VIII in FIG. 7.
Figure 9:
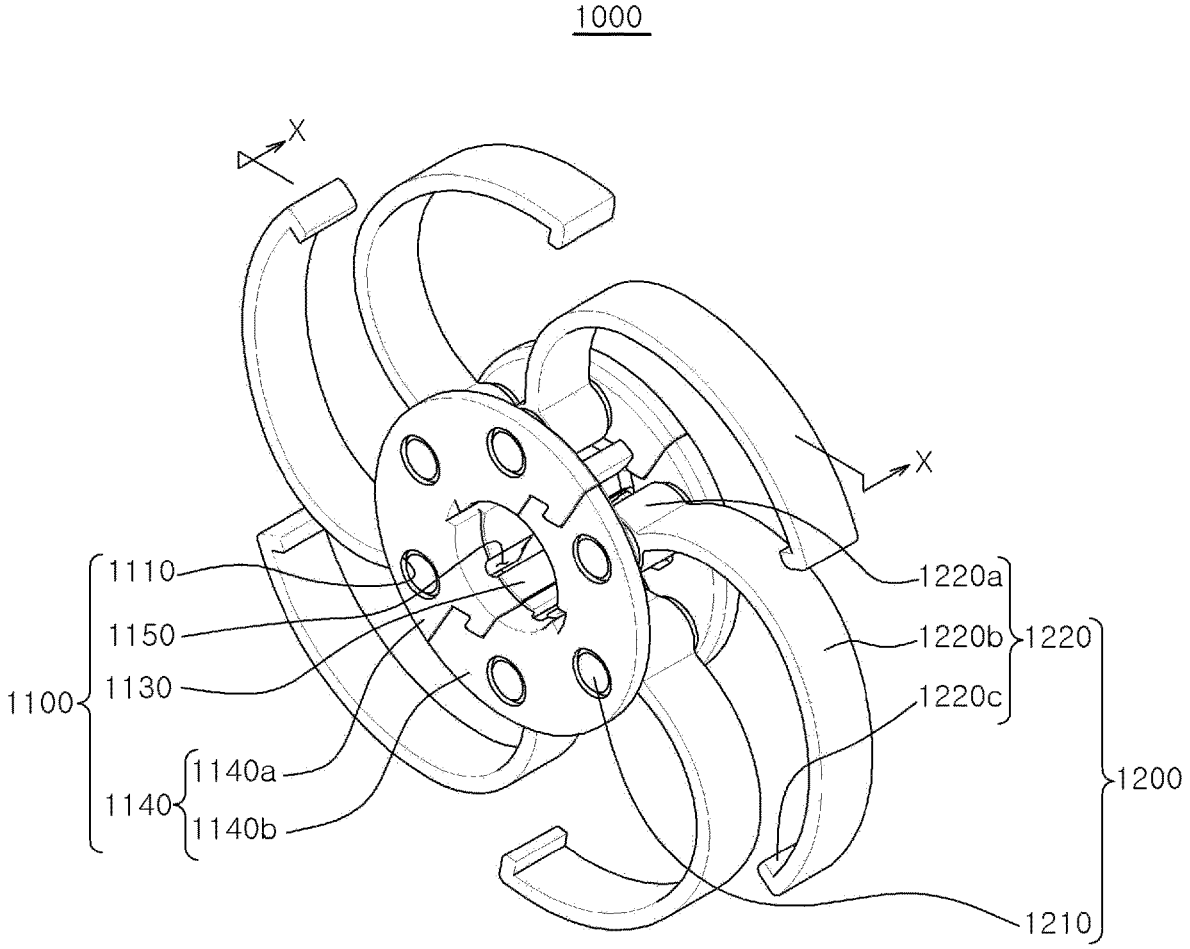
FIG. 9 is a perspective view showing a state in which the vanes are unfolded in the medium stacking sheet according to the second embodiment of the present disclosure.
Figure 10:
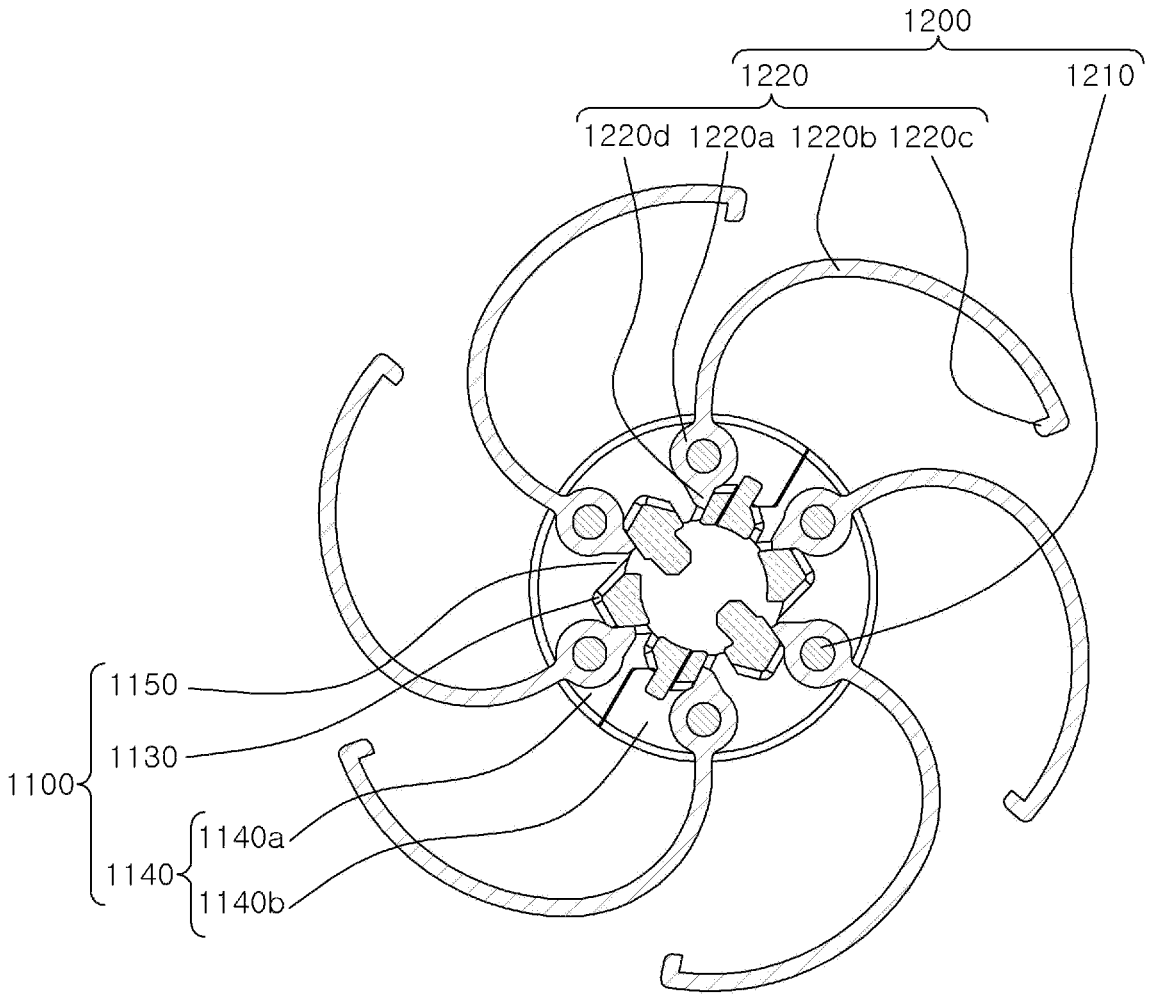
FIG. 10 is a sectional view taken along line X-X in FIG. 9.
Figure 11:
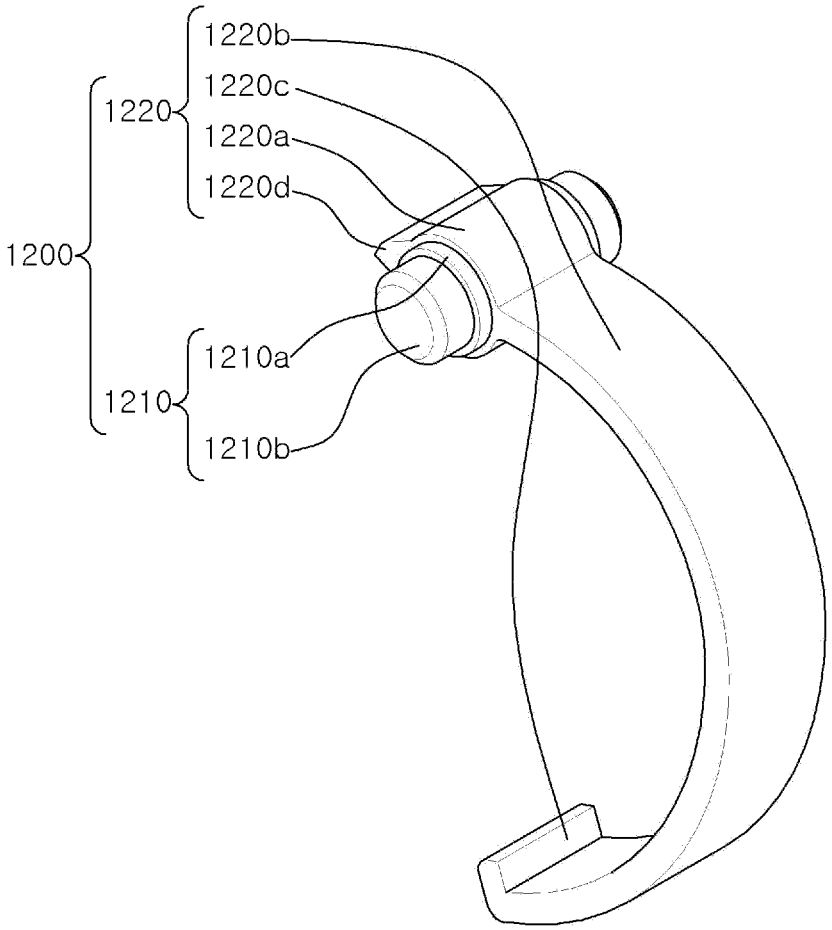
FIG. 11 is a perspective view showing one of the vanes of the medium stacking sheet according to the second embodiment of the present disclosure.

FIG. 7 is a perspective view showing a medium stacking sheet according to a second embodiment of the present disclosure. FIG. 8 is a sectional view taken along line VIII-VIII in FIG. 7. FIG. 9 is a perspective view showing a state in which the vanes are unfolded in the medium stacking sheet according to the second embodiment of the present disclosure. FIG. 10 is a sectional view taken along line X-X in FIG. 9. FIG. 11 is a perspective view showing one of the vanes of the medium stacking sheet according to the second embodiment of the present disclosure.

As shown in FIGS. 7 to 11, the medium stacking sheet 1000 according to the second embodiment of the present invention may include a body 1100 and vanes 1200.

Specifically, the body 1100 may be fixed to the rotation shaft of the guide roller for stacking or dispensing the medium. The body 1100 may include a support plate 1140, rotation holes 1110, stopper bump portions 1130 and stopper groove portions 1150.

At the center of the support plate 1140, there may be formed a central hole to which a rotation shaft can be coupled. There may be provided a pair of support plates 1140 disposed opposite to each other so as to be connected through the stopper bump portions 1130.

The support plate 1140 may include a first plate piece 1140*a* and a second plate piece 1140*b*. The first plate piece 1140*a* may have a semicircle shape and may form one side portion of the support plate 1140. The second plate piece 1140*b* may have a semicircle shape corresponding to the shape of the first plate piece 1140*a* and may form the other side portion of the support plate 1140. The first plate piece 1140*a* and the second plate piece 1140*b* may be assembled by snap-fit. Since the snap fit assembly is a concept corresponding to the conventional snap fit assembly using a cantilever deformation theory, the detailed description thereof will be omitted.

The rotation holes 1110 may be provided in the form of holes formed along the edge of the support plate 1140. The rotation holes 1110 may be spaced apart at regular intervals in the circumferential direction along the edge of the support plate 1140. The rotation holes 1110 may be formed in a shape corresponding to the vane pins 1210 of the vanes 1200 so that the vanes 1200 can be rotatably mounted.

The stopper bump portions 1130 may connect a pair of support plates 1140 arranged side by side. The stopper bump portions 1130 may be spaced apart along the circumferential direction at the central portion of the support plate 1140.

The stopper groove portions 1150 may be provided as rotation limiting spaces formed between the stopper bump portions 1130. At least a portion (e.g., a stopper portion) of the plate piece 1220 is positioned in each of the stopper groove portions 1150. Therefore, when the vane piece 1220 is unfolded from the body 1100 through the vane pin 1210, the vane piece 1220 can be rotated within a certain angle range.

For example, when the vane piece 1220 is unfolded from the body 1100 in response to the rotation of the body 1100, the stopper portion 1220*d* of the vane piece 1220 is located in each of the stopper grooves 1150. Therefore, the rotation of each of the vanes 1200 may be limited to within a certain angular range even when the body 1100 continues to rotate.

The vanes 1200 may be provided so as to be rotatably mounted to the rotation holes 1110 of the body 1100, respectively. When the body 1100 is rotated in the medium stacking direction, the vanes 1200 may be unfolded from the body 1100 to uniformly stack the medium in the stacking space of the medium storage part. In addition, when the body 1100 is rotated in the medium dispensing direction, the vanes 1200 may be simultaneously folded toward the body 1100 so as not to interfere with the medium, whereby the vanes 1200 can be retracted from a medium conveyance path.

Each of the vanes 1200 may include a vane pin 1210 rotatably mounted to each of the rotation holes 1110 and a vane piece 1220 coupled to the vane pin 1210 so as to stack a medium.

The vane pin 1210 may include a support portion 1210*a* to which one end of the vane piece 1220 is fixed, and shaft portions 1210*b* provided at both ends of the support portion 1210*a*. The support portion 1210*a* may be rotated in each of the rotation holes 1110 in conjunction with the rotation of the body 1100. The shaft portions 1210*b* may have a diameter smaller than the diameter of the support portion 1210*a* so that the shaft portions 1210*b* can be rotatably inserted into the rotation holes 1110. The shaft portions 1210*b* may have a diameter corresponding to the diameter of the rotation holes 1110 so as to be rotatable in the rotation holes 1110.

The vane piece 1220 may be made of a flexible material. In this case, the vane pieces 1220 may be made of a flexible material that is restricted from being unfolded (bent) over 90 degrees from the body 1100 when the body 1100 is rotated in the medium stacking direction.

The vane piece 1220 may include a vane portion 1220*b*, a coupling portion 1220*a* provided at one end of the vane portion 1220*b* so as to be coupled to the support portion 1210*a*, a protruding portion 1220*c* formed to protrude from the other end of the vane portion 1220*b* in a direction perpendicular to an extension direction of the vane portion 1220*b*, and a stopper portion 1220*d* protruding in a wedge shape from the coupling portion 1220*a*. Since the stopper portion 1220*d* is located in the stopper groove portion 1150 of the body 1100, the rotation angle of the vane piece 1220 may be limited to a predetermined angle range when the vane piece 1220 rotates.

Figure 12:
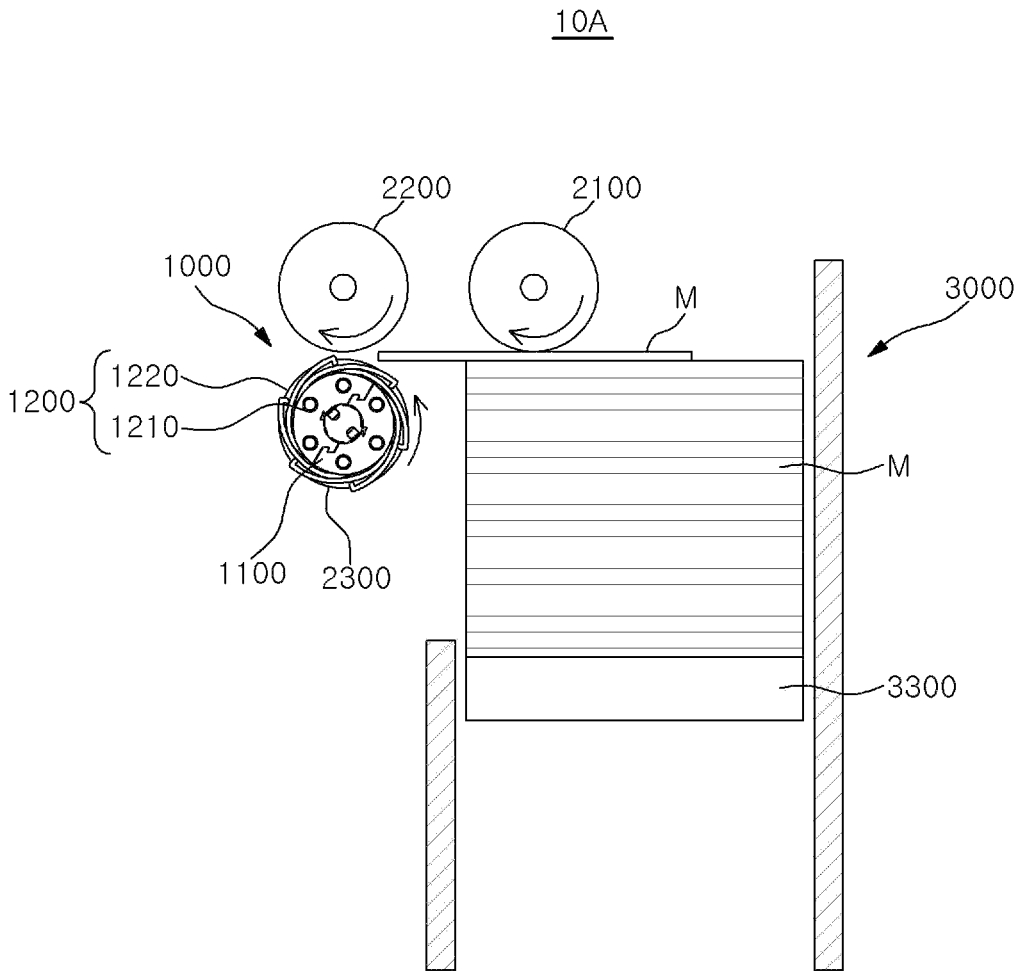
FIG. 12 is a view illustrating the state of the medium stacking sheet when a medium is stacked in a medium separating and stacking apparatus according to the second embodiment of the present disclosure.
Figure 13:
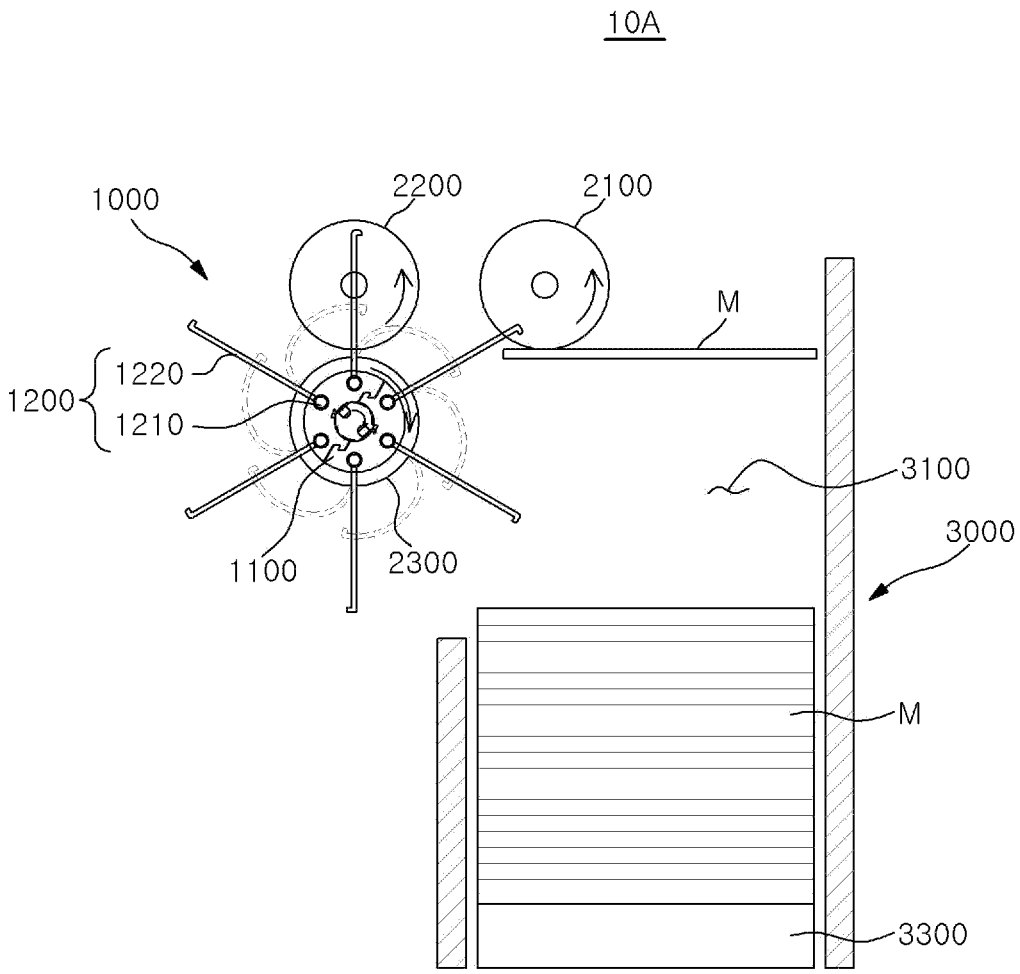
FIG. 13 is view illustrating the state of the medium stacking sheet when the medium is separated in the medium separating and stacking apparatus according to the second embodiment of the present disclosure.

FIG. 12 is a view illustrating the state of the medium stacking sheet when a medium is stacked in a medium separating and stacking apparatus according to the second embodiment of the present disclosure. FIG. 13 is view illustrating the state of the medium stacking sheet when the medium is separated in the medium separating and stacking apparatus according to the second embodiment of the present disclosure.

As shown in FIGS. 12 and 13, the medium separating and stacking apparatus 10A according to the second embodiment of the present disclosure may include a medium storage part 3000 capable of stacking a medium M, and a stacking/dispensing part for stacking the medium M in the medium storage part 3000 through the medium stacking sheet 1000.

Specifically, the medium storage part 3000 may be provided in the form of a box capable of storing the medium M. The medium storage part 3000 may provide a stacking space 3100 capable of storing the medium M. A stacking plate 3300 movable in the vertical direction may be provided in the stacking space 3100. The medium M may be stacked on the upper surface of the stacking plate 3300.

The stacking plate 3300 may be moved to the lower side of the medium storage part 3000 to secure the stacking space 3100 for the medium M. When stacking the medium M, the medium M passed through the stacking/dispensing part may be dropped and stacked in the stacking space 3100 while the rear end of the medium M is struck by the vanes 1200 of the medium stacking sheet 1000.

In addition, the stacking plate 3300 may be moved to the upper side of the medium storage part 3000 to separate the medium M stored in the stacking space 3100 to the outside. The vertical movement of the stacking plate 3300 may be implemented through an actuator controlled by a controller.

The stacking/dispensing part may include a pickup roller 2100 for dispensing the medium M one by one from the medium storage part 3000, a feed roller 2200 disposed adjacent to the pick-up roller 2100 and configured to transfer the medium M separated by the pick-up roller 2100 onto the conveyance path P or stack the medium M conveyed along the conveyance path P into the medium storage part 3000, a guide roller 2300 overlapped with the feed roller 2200 and configured to feed the medium M while preventing two sheets of medium M from being conveyed simultaneously, and a medium stacking sheet 1000 provided coaxially with the rotation axis of the guide roller 2300.

A plurality of vanes 1200 may be arranged on the outer circumferential surface of the medium stacking sheet 1000 so as to be spaced apart along the circumferential direction. The detailed configuration of the medium stacking sheet 1000 corresponds to the one described above. Therefore, the detailed description thereof will be omitted.

As shown in FIG. 11, in the process of stacking the medium M conveyed along the conveyance path into the medium storage part 3000, the medium stacking sheet 1000 enters the conveyance path to strike the rear end of the medium M, whereby the medium M can be uniformly stacked into the medium storage part 3000.

As shown in FIG. 12, in the process in which the medium M is separated from the medium storage part 3000 toward the conveyance path, the vanes 1200 of the medium stacking sheet 1000 is folded toward body 1100 so as not to interfere with the medium M, whereby the medium stacking sheet 1000 can be retracted from the conveyance path.

As described above, according to the second embodiment of the present disclosure, the vanes of the medium stacking sheet are rotatably mounted on the body. Therefore, it is possible to prevent damage to the connection portions of the vanes due to the bending of the vanes.

While the embodiments of the present disclosure have been described with reference to the accompanying drawings, it will be understood by those skilled in the art that the present disclosure can be implemented in other specific forms without changing the technical spirit or essential features of the present disclosure. For example, those skilled in the art can implement the present disclosure in the form that is not clearly described in the embodiments of the present disclosure by changing materials, sizes and the like of the respective components depending on application fields or by combining or replacing the embodiments without departing from the scope of the present disclosure. Therefore, it should be noted that the above-described embodiments are merely illustrative in all aspects and are not to be construed as limiting the present disclosure and also that the modifications are included in the technical spirit of the present disclosure which is described in the following claims.

What is claimed is:

1. A medium stacking sheet installed on a rotation shaft of a medium separating and stacking apparatus for stacking or dispensing a medium, comprising:

a body fixed to the rotation shaft and having a plurality of rotation holes which are spaced apart from each other in a rotation direction of the rotation shaft; and a plurality of vanes each including a vane pin rotatably installed in a corresponding rotation hole and a vane piece coupled to the vane pin to stack the medium, wherein the body further includes:

a support plate having a central hole to which the rotation shaft is coupled, the rotation holes being disposed in an edge portion of the support plate;

a plurality of stopper bump portions provided to be circumferentially spaced apart from each other in a central portion of the support plate; and a plurality of stopper groove portions each of which is formed between the adjacent stopper bump portions so that at least a portion of the vane piece is rotated within a predetermined angular range when the vane piece is unfolded, and wherein the vane piece includes:

a vane portion;

a coupling portion provided at one end of the vane portion to be coupled to the vane pin;

a stopper portion protruded from the coupling portion, the stopper portion being located in each of the stopper groove portions of the body to limit rotation of the vane piece.

2. The medium stacking sheet of claim 1, wherein the support plate includes:

a first plate piece provided to have a semicircular shape; and a second plate piece provided to have a semicircular shape corresponding to the first plate piece and assembled to the first plate piece by snap-fit.

3. The medium stacking sheet of claim 1, wherein the vane pin includes:

a support portion to which one end of the vane piece is fixed; and shaft portions provided at both ends of the support portion to be rotatably inserted into the rotation holes.

4. The medium stacking sheet of claim 1, wherein the vane piece further includes:

a protruding portion formed to protrude from the other end of the vane portion in a direction perpendicular to an extension direction of the vane portion.

5. The medium stacking sheet of claim 1, wherein the vanes are rotatably coupled in an outer peripheral portion of the body and are configured to stack the medium by being unfolded from the body when the body is rotated in order for a medium to be stacked and configured to be folded toward the body when the body is rotated in order for a medium to be dispensed.

6. A medium stacking sheet installed on a rotation shaft of a medium separating and stacking apparatus for stacking or dispensing a medium, comprising:

a body having an outer circumferential surface and a plurality of mounting grooves formed on the outer circumferential surface, the body being rotatably fixed to the rotation shaft;

a plurality of vanes each including a vane pin rotatably coupled in a corresponding mounting groove and a vane piece fixed to the vane pin to stack the medium; and a plurality of stoppers each provided on the body to limit a rotation of the vane pin within a predetermined angle range when the vane piece is unfolded, wherein the vane pin includes locking pieces provided in an axial direction of the rotation shaft, and wherein each of the locking pieces includes:

a first locking portion supported by a corresponding stopper when the vane piece is unfolded;

a second locking portion disposed opposite to the first locking portion and smaller than the first locking portion to avoid interference with the corresponding stopper.

7. The medium stacking sheet of claim 6, wherein the vane pin further includes: a support base rotatably coupled with the corresponding mounting groove, one end of the vane piece being fixed to the support base, and wherein the locking pieces are provided at both ends of the support base in the axial direction of the rotation shaft.

8. The medium stacking sheet of claim 7, wherein the first locking portion has a semi-circular shape, and the second locking portion has a semi-circular shape having a smaller diameter than the semi-circular shape of the first locking portion, and wherein each of the locking pieces further includes an elastic groove portion provided in a groove shape between the first locking portion and the second locking portion.

9. The medium stacking sheet of claim 8, wherein the first locking portion and the second locking portion are disposed symmetrically at both ends of the support base with respect to a central longitudinal cross section of the support base.

10. The medium stacking sheet of claim 6, wherein the vanes are rotatably coupled on the outer circumferential surface of the body and are configured to stack the medium by being unfolded from the body when the body is rotated in order for a medium to be stacked and configured to be folded toward the body when the body is rotated in order for a medium to be dispensed.

11. A medium separating and stacking apparatus comprising:

a rotation shaft configured to be rotated when stacking or dispensing a medium; and a medium stacking sheet installed on the rotation shaft, wherein the medium stacking sheet includes:

a body having an outer circumferential surface and a plurality of mounting grooves formed on the outer circumferential surface, the body being rotatably fixed to the rotation shaft;

a plurality of vanes each including a vane pin rotatably coupled in a corresponding mounting groove and a vane piece fixed to the vane pin to stack the medium; and a plurality of stoppers each provided on the body to limit a rotation of the vane pin within a predetermined angle range when the vane piece is unfolded, wherein the vane pin includes locking pieces provided in an axial direction of the rotation shaft, and wherein each of the locking pieces includes:

a first locking portion supported by a corresponding stopper when the vane piece is unfolded;

a second locking portion disposed opposite to the first locking portion and smaller than the first locking portion to avoid interference with the corresponding stopper.

12. The medium separating and stacking apparatus of claim 11, wherein the vane pin further includes: a support base rotatably coupled with the corresponding mounting groove, one end of the vane piece being fixed to the support base, and wherein the locking pieces are provided at both ends of the support base in the axial direction of the rotation shaft.

13. The medium separating and stacking apparatus of claim 12, wherein the first locking portion has a semi-circular shape, and the second locking portion has a semi-circular shape having a smaller diameter than the semi-circular shape of the first locking portion, and wherein each of the locking pieces further includes an elastic groove portion provided in a groove shape between the first locking portion and the second locking portion.

14. The medium separating and stacking apparatus of claim 13, wherein the first locking portion and the second locking portion are disposed symmetrically at both ends of the support base with respect to a central longitudinal cross section of the support base.

15. The medium separating and stacking apparatus of claim 11, wherein the vanes are rotatably coupled on the outer circumferential surface of the body and are configured to stack the medium by being unfolded from the body when the body is rotated in order for a medium to be stacked and configured to be folded toward the body when the body is rotated in order for a medium to be dispensed.

* * * * *